US009108445B2

(12) United States Patent
Sakano

(10) Patent No.: US 9,108,445 B2
(45) Date of Patent: Aug. 18, 2015

(54) LIQUID EJECTING APPARATUS

(75) Inventor: Yuji Sakano, Toyota (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 58 days.

(21) Appl. No.: 13/599,973

(22) Filed: Aug. 30, 2012

(65) Prior Publication Data

US 2013/0050380 A1 Feb. 28, 2013

(30) Foreign Application Priority Data

Aug. 31, 2011 (JP) ..... 2011-189566

(51) Int. Cl.
*B41J 2/01* (2006.01)
*B41J 13/14* (2006.01)
*B41J 11/00* (2006.01)

(52) U.S. Cl.
CPC ..... *B41J 13/14* (2013.01); *B41J 11/006* (2013.01)

(58) Field of Classification Search
CPC ..... B41J 11/02; B41J 11/04; B41J 11/26; B41J 11/27; B41J 11/28; B41J 11/30; B41J 11/32; B41J 11/34
USPC ..... 347/42, 101, 104
See application file for complete search history.

(56) References Cited

U.S. PATENT DOCUMENTS

| | | | | |
|---|---|---|---|---|
| 7,232,269 | B2 * | 6/2007 | Ohyama | 400/642 |
| 7,513,599 | B2 * | 4/2009 | Wada et al. | 347/42 |
| 2006/0061645 | A1 | 3/2006 | Dohki | |
| 2006/0239734 | A1 | 10/2006 | Ohtsuki | |

FOREIGN PATENT DOCUMENTS

| | | | |
|---|---|---|---|
| JP | S63-254044 | A | 10/1988 |
| JP | 2000-211762 | A | 8/2000 |
| JP | 2005-145576 | A | 6/2005 |
| JP | 2005-169957 | A | 6/2005 |
| JP | 2006-111002 | A | 4/2006 |
| JP | 2006-298599 | A | 11/2006 |
| JP | 2008-12890 | A | 1/2008 |

OTHER PUBLICATIONS

Office Action issued in related Japanese Patent Application No. 2011-189566, mailed Dec. 16, 2014.

* cited by examiner

*Primary Examiner* — Geoffrey Mruk
(74) *Attorney, Agent, or Firm* — Merchant & Gould PC

(57) ABSTRACT

A liquid ejecting apparatus, including: a head having an ejection surface; and a conveyance mechanism configured to convey a recording medium in a conveyance direction such that the recording medium passes a recording position at which the recording medium is opposed to the ejection surface, the conveyance mechanism including a curved-passage defining portion which defines a curved passage located on a downstream side of the recording position in the conveyance direction and a flat-passage defining portion which defines a flat passage which is located between the recording position and the curved passage and which is parallel to the ejection surface, a trailing end portion of the recording medium being located at the recording position when a leading end portion of the recording medium is located at the curved passage, wherein the flat-passage defining portion includes at least two roller pairs which are disposed so as to define the flat passage.

13 Claims, 4 Drawing Sheets

LIQUID EJECTING APPARATUS

CROSS REFERENCE TO RELATED APPLICATION

The present application claims priority from Japanese Patent Application No. 2011-189566, which was filed on Aug. 31, 2011, the disclosure of which is herein incorporated by reference in its entirety.

BACKGROUND OF THE INVENTION

1. Field of the Invention

The present invention relates to a liquid ejecting apparatus configured to eject a liquid such as ink.

2. Description of Related Art

A liquid ejecting apparatus is known which includes a line-type head and a conveyance mechanism configured to convey a recording medium in a conveyance direction such that the recording medium passes a recording position at which the recording medium is opposed to the ejection surface of the head.

In the known apparatus, a platen is disposed at the recording position at which the recording medium is opposed to the ejection surface of the head. The recording medium is conveyed along a substantially horizontal conveyance passage which includes a surface of the platen (the recording position) and is finally discharged to a discharge tray.

SUMMARY OF THE INVENTION

As the conveyance passage defined by the conveyance mechanism, a curved passage is considered other than the substantially horizontal conveyance passage described above. The applicant of the present invention has studied a structure of the conveyance mechanism which permits a trailing end portion of the recording medium to be located at the recording position when a leading end portion of the recording medium is located at the curved passage, in an instance where the curved passage is disposed on a downstream side of the recording position in the conveyance direction. As a result of the study, it has been revealed that the following problems may arise.

For instance, the following problem may arise. In an instance where the curved passage is disposed on one of opposite sides of the recording position on which the ejection surface is present, a force in a direction from the ejection surface toward the recording position acts on the trailing end portion of the recording medium when the leading end portion of the recording medium is located at the curved passage. Due to the force, the trailing end portion of the recording medium is pressed onto a surface of a support member such as the platen disposed at the recording position. As a result, there is generated a reaction force, and the reaction force causes the trailing end portion of the recording medium to float, in other words, the force causes the trailing end portion of the recording medium to move away from the recording position and to approach the ejection surface. In this instance, a distance between the recording medium and the ejection surface may be changed, so that image quality may be deteriorated or the recording medium may come into contact with the ejection surface.

On the other hand, in an instance where the curved passage is disposed on the other of the opposite sides of the recording position on which the ejection surface is not present, a force in a direction from the recording position to the ejection surface acts on the trailing end portion of the recording medium when the leading end portion of the recording medium is located at the curved passage. The force causes the trailing end portion of the recording medium to float, so that the same problem as described above may arise.

The present invention has developed to provide a liquid ejecting apparatus in which the trailing end portion the recording medium is prevented from floating even in an instance where the curved passage is provided on a downstream side of the recording position in the conveyance direction.

The present invention provides a liquid ejecting apparatus, including:

a line-type head having an ejection surface in which are open a plurality of ejection openings through which a liquid is ejected to a recording medium; and a conveyance mechanism configured to convey the recording medium in a conveyance direction such that the recording medium passes a recording position at which the recording medium is opposed to the ejection surface, the conveyance mechanism including a curved-passage defining portion which defines a curved passage located on a downstream side of the recording position in the conveyance direction and a flat-passage defining portion which defines a flat passage which is located between the recording position and the curved passage and which is parallel to the ejection surface, a trailing end portion of the recording medium being located at the recording position when a leading end portion of the recording medium is located at the curved passage, wherein the flat-passage defining portion includes at least two roller pairs which are disposed so as to define the flat passage.

BRIEF DESCRIPTION OF THE DRAWINGS

The above and other objects, features, advantages and technical and industrial significance of the present invention will be better understood by reading the following detailed description of an embodiment of the invention, when considered in connection with the accompanying drawings, in which.

DETAILED DESCRIPTION OF THE EMBODIMENT

Hereinafter, one embodiment of the present invention will be explained with reference to the drawings.

Figure 1:
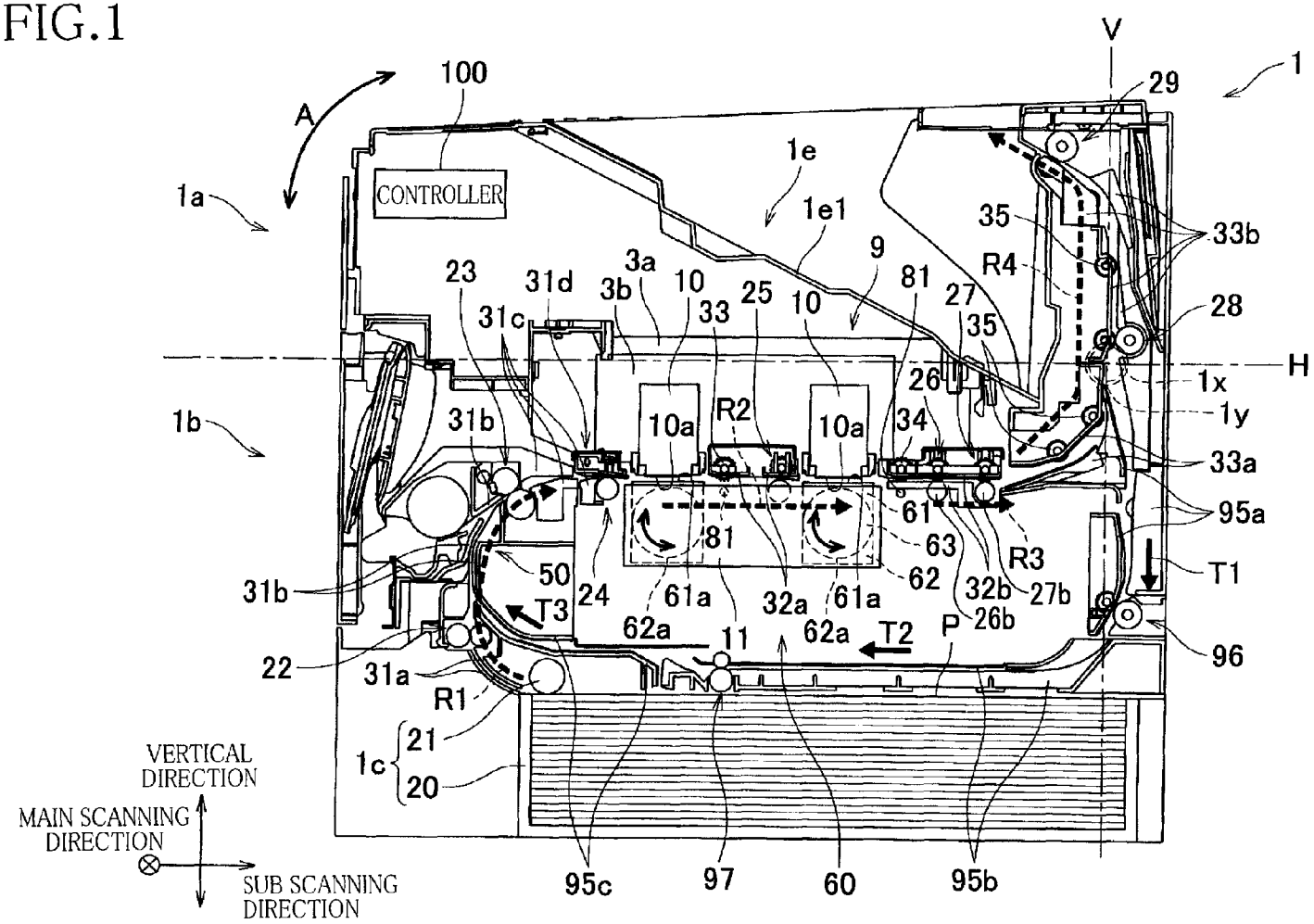
FIG. 1 is a schematic side view showing an inside of an ink-jet printer according to one embodiment of the present invention.

Referring first to FIG. 1, there will be explained an overall structure of an ink-jet printer constructed according to one embodiment of the present invention.

The printer generally indicated at 1 in FIG. 1 includes an upper casing 1*a* and a lower casing 1*b* which have a rectangular parallelepiped shape and which have substantially the same size. The upper casing 1*a* is open at its lower surface while the lower casing 1*b* is open at its upper surface. The upper casing 1*a* is stacked on the lower casing 1*b*, so that openings of the upper casing 1*a* and the lower casing 1*b* are closed or sealed so as to define an internal space of the printer 1.

In the upper casing 1*a*, there is provided a pivot shaft 1*x* extending along a main scanning direction (i.e., a direction orthogonal to a sheet plane of FIG. 1). The center of the pivot shaft 1*x* is a point of intersection of a straight line V in the vertical direction and a straight line H in the horizontal direction. In the lower casing 1*b*, there is provided a bearing 1*y* rotatably supporting the pivot shaft 1*x*. In the arrangement, the upper casing 1*a* is pivotable with respect to the lower casing 1*b* in a direction A about the pivot shaft 1*x*. When the upper casing 1*a* pivots upward, a part of a conveyance passage of a sheet P as a recording medium is exposed to an exterior, whereby a work space for a user is ensured between the upper casing 1*a* and the lower casing 1*b*. The user can manually perform a jam clearing processing (for clearing a jam of the sheet P in the conveyance passage) utilizing the work space.

A discharge portion 1*e* is provided on an upper surface of an upper wall of the upper casing 1*a*. As shown in FIG. 1, in the space defined by the upper casing 1*a* and the lower casing 1*b* (i.e., the internal space of the printer 1), the conveyance passage through which the sheet P is conveyed from a sheet supply unit 1*c* to the discharge portion 1*e* is formed.

In the internal space of the printer 1, there are disposed: a head unit 9 including two heads 10 configured to eject respective liquids; two cartridges (not shown) corresponding to the respective two heads 10; a support portion 60; the sheet supply unit 1*c*, a conveyance unit 50, a wiping unit 80 (FIG. 3); and a controller 100 configured to control various portions of the printer 1. In FIG. 1, slide shafts 81 of wipers of the wiping unit are shown.

The head unit 9 includes: the two heads 10; a head holder holding the two heads 10 and including a main body 3*a* and a carriage 3*b*; and a carriage moving mechanism 3*c* (FIG. 3) configured to move the carriage 3*b* in the vertical direction. One of the two heads 10 disposed on an upstream side in a conveyance direction of the sheet P is a pre-coat head for ejecting a pre-treatment liquid while the other of the two heads 10 disposed on a downstream side in the conveyance direction is an ink-jet head for ejecting black ink.

The two heads 10 have the same structure and are line-type heads having a longer dimension in the main scanning direction. The two heads 10 have a generally rectangular parallelepiped contour. The two heads 10 are spaced from each other in a sub scanning direction (which is orthogonal to the main scanning direction and the vertical direction) and are fixed to the carriage 3*b*. The carriage 3*b* is supported by the upper casing 1*a* via the main body 3*a* of the head holder. The main body 3*a* is fixed to the upper casing 1*a* and supports the carriage 3*b* such that the carriage 3*a* is reciprocatingly movable in the vertical direction.

A lower surface of each head 10 is an ejection surface 10*a* in which a multiplicity of ejection openings are open. In each head 10, there are formed flow passages through which the pre-treatment liquid or the black ink (hereinafter referred to as a "liquid") supplied from the cartridge reaches the ejection openings. The pre-treatment liquid has a function of preventing ink spreading and strikethrough, a function of improving color development property and quick-drying property, and so on.

The support portion 60 is supported by the lower casing 1*b* and is disposed so as to be opposed to the ejection surfaces 10*a* of the respective heads 10 in the vertical direction. The support portion 60 includes two rotary members 63 which are opposed to the respective heads 10, two platens 61 and two opposable members 62 which are fixed to circumferential surfaces of the corresponding rotary members 63, a frame 11 which rotatably supports the rotary members 63, and a rotary-member rotating mechanism 60*a* (FIG. 3) configured to rotate the rotary members 63 about respective rotation axes extending along the main scanning direction.

Each platen 61 and each opposable member 62 has dimensions in the main scanning direction and in the sub scanning direction which are slightly larger than those of the ejection surface 10*a*. The platen 61 and the opposable member 62 are disposed so as to be opposed to each other in the vertical direction.

The surface of the platen 61 is a support surface 61*a* for supporting the sheet P while being opposed to the ejection surface 10*a*. On the support surface 61*a*, a plurality of ribs each extending along the sub scanning direction are formed for reducing an area of contact with the sheet P placed on the support surface 61*a*, thereby reducing a conveyance load. The platen 61 is disposed such that the upper surface of the sheet P placed on the support surface 61 does not contact the ejection surface 10*a*.

Each opposable member 62 is formed of a material that inhibits or hardly inhibits transmission of an aqueous component therethrough. For instance, the opposable member 62 is formed of metal or glass. The surface of the opposable member 62 is smooth and functions as an opposable face 62*a* to be opposed to the ejection surface 10*a*.

By rotation of the rotary members 63, there are selectively established: a first state (FIG. 1) in which the support surfaces 61*a* are opposed to the corresponding ejection surfaces 10*a* and the opposable faces 62*a* are not opposed to the corresponding ejection surfaces 10*a*; and a second state (not shown) in which the support surfaces 61*a* are not opposed to the corresponding ejection surfaces 10*a* and the opposable faces 62*a* are opposed to the corresponding ejection surfaces 10*a*. The controller 100 controls the rotary-member rotating mechanism 60*a* such that the first state is established when an image is recorded on the sheet P by ejection of the liquids from the ejection openings toward the sheet P and such that the second state is established when capping is carried out. Here, the capping refers to an operation in which a lower end of a cap member (not shown) that protrudes downward from a lower peripheral end of each head 10 comes into contact with a corresponding one of the opposable faces 62*a*, whereby a space opposed to the ejection surface 10*a* is hermetically closed or sealed from an external space.

The sheet supply unit 1*c* is provided at the lowermost portion of the lower casing 1*b* that is below the head unit 9 and the support portion 60. The sheet supply unit 1*c* includes a sheet tray 20 and a sheet supply roller 21. The sheet tray 20 is a box opening upward, and the sheets P with a prescribed size (such as A4 size) can be accommodated in the sheet tray 20. The sheet supply roller 21 is configured to rotate under a control of the controller 100 and to supply an uppermost one of the sheets P accommodated in the sheet tray 20.

The conveyance passage defined by the conveyance unit 50 includes passages R1, R2, R3, R4 used for ordinary conveyance and passages T1, T2, T3 used for re-conveyance. The conveyance unit 50 includes the following components that define the passages R1-R4, T1-T3 and a conveyance motor (not shown).

Where single-sided recording is performed, namely, where recording is performed only on a front surface of the sheet P, the conveyance unit 50 conveys the sheet P supplied from the sheet supply unit 1*c* along the passages R1-R4 for ordinary conveyance, so as to finally discharge the sheet P to the discharge portion 1*e*. In this instance, the sheet P is discharged to the discharge portion 1*e* after the recording was performed, at the passage R2, on the front surface of the sheet P which had faced downward in the sheet tray 20.

Where duplex recording is performed, namely, where recording is performed on a back surface of the sheet P by turning the sheet P upside down after recording has been performed on the front surface of the sheet P, the conveyance unit 50 initially conveys the sheet P supplied from the sheet supply unit 1*c*, to a roller pair 29 along the passages R1-R4 for ordinary conveyance. In this instance, the sheet P is in a state in which recording has been performed, at the passage R2, on its front surface. Subsequently, the conveyance unit 50 permits the sheet P nipped by rollers of a roller pair 28 and rollers of the roller pair 29 to be conveyed back by reverse rotation of the rollers of the roller pairs 28, 29, without discharging the sheet P to the discharge portion 1*e*. The sheet P conveyed back from the roller pairs 28, 29 are conveyed along the passages T1-T3 for re-conveyance and is sent to an intermediate portion of the passage R1 (i.e., a portion of the passage R1 located on a downstream side of a roller pair 22 in the conveyance direction). Thereafter, the conveyance unit 50 conveys the sheet P that has been sent to the passage R1 from the intermediate portion of the passage R1 again along the passages R1-R4 for ordinary conveyance, so as to discharge the sheet to the discharge portion 1*e*. In this instance, the sheet P is discharged to the discharge portion 1*e* after the recording was performed, at the passage R2, on the back surface of the sheet P which had faced upward in the sheet tray 20.

The discharge portion 1*e* has a support member 1*e*1 for supporting the discharged sheet P. The support member 1*e*1 is constituted by the upper wall of the upper casing 1*a*. At the discharge portion 1*e*, the recorded surface of the sheet P on which an image has been recorded faces downward so as to be opposed to the support member 1*e*1. Here, in the duplex recording, the recorded surface of the sheet P refers to the surface on which an image has been recorded immediately before the sheet P is discharged to the discharge portion 1*e*.

Figure 4:
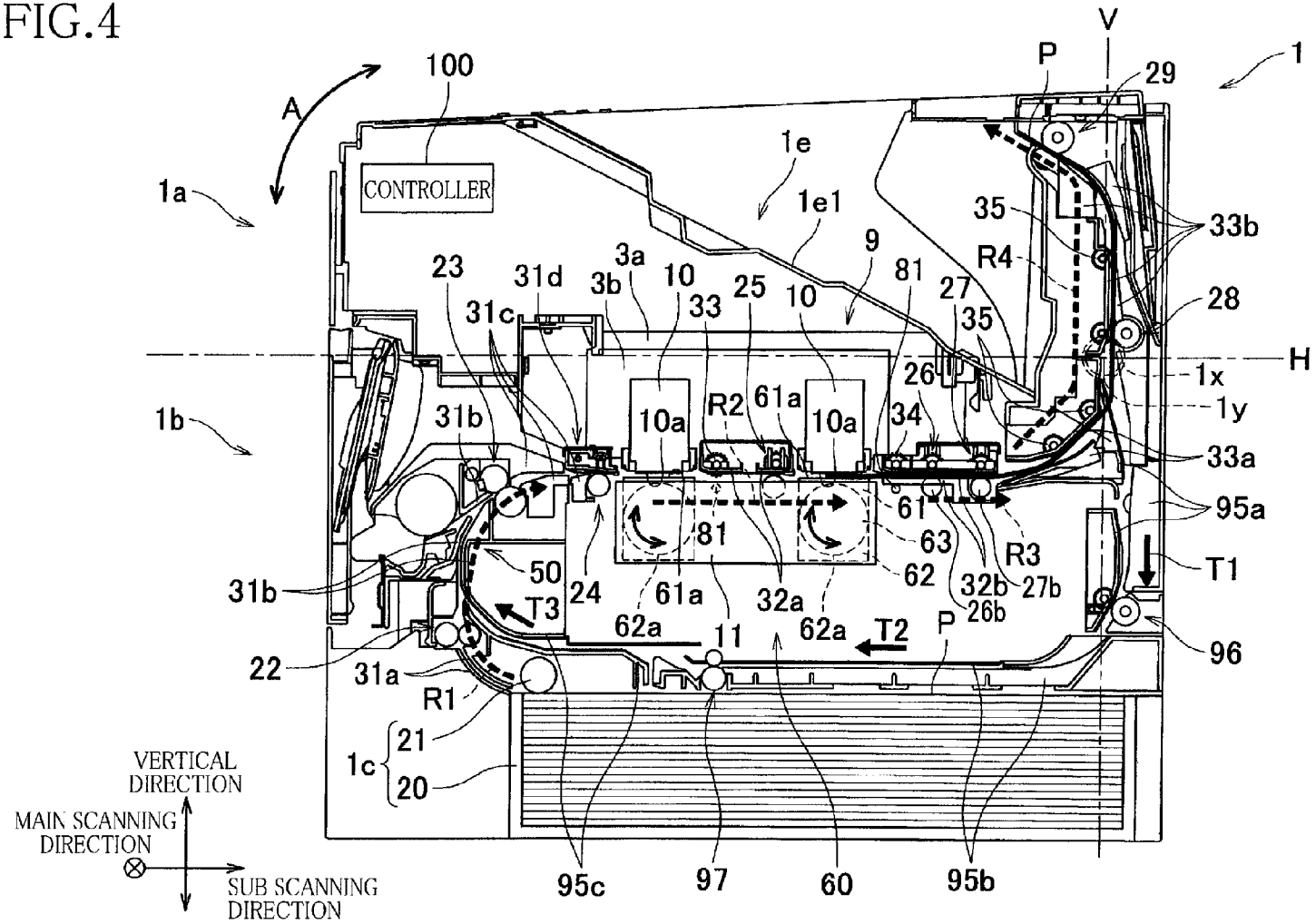
FIG. 4 is a view showing a state in which a trailing end portion of a sheet is located at a recording position when a leading end portion of the sheet is located at a curved passage, the view corresponding to FIG. 1.

The conveyance unit 50 is configured such that a trailing end portion of the sheet P is located at a recording position at which the sheet P is opposed to the ejection surface 10*a* of the ink-jet head 10 (FIG. 4) when a leading end of the sheet P is located at the passage R4. In the present embodiment, the conveyance unit 50 is configured to covey the sheet P of a prescribed size (such as A4 size).

The passage R1 is a curved passage which has a U-letter shape as viewed in the main scanning direction in FIG. 1 and which extends from the sheet supply unit 1*c* to a recording position at which the sheet P is opposed to the ejection surface 10*a* of the pre-coat head 10. The passage R1 is defined by a guide 31*a*, the roller pair 22, a guide 31*b*, a roller pair 23, a guide 31*c*, a guide 31*d*, and a roller pair 24. These components are disposed in the order of description from the upstream side in the conveyance direction.

The passage R2 is a passage which passes the two recording positions of the respective heads 10 and is defined by a guide 32*a*, a press roller 33, and a roller pair 25. These components are disposed between the two heads 10. The press roller 33 and the roller pair 25 are disposed in the order of description from the upstream side in the conveyance direction.

The passage R3 is a passage parallel to the ejection surface 10*a* of the ink-jet head 10 (i.e., a flat passage or linear passage) between the passage R4 and the recording position at which the sheet P is opposed to the ejection surface 10*a* of the ink-jet head 10. The passage R3 is defined by a guide 32*b*, a press roller 34, and roller pairs 26, 27. The press roller 34 and the roller pairs 26, 27 are disposed in the order of description from the upstream side in the conveyance direction. The press roller 34 disposed between the recording position and the roller pairs 26, 27 functions as an intermediate roller.

The passage R4 is a curved passage which has a U-letter shape as viewed in the main scanning direction in FIG. 1 and which is located on the downstream side of the recording position at which the sheet P is opposed to the ejection surface 10*a* of the ink-jet head 10, so as to extend to the discharge portion 1*e*. The passage R4 is defined by a guide 33*a*, a guide 33*b*, press rollers 35, and the roller pairs 28, 29. The roller pairs 28, 29 are disposed in the order of description from the upstream side in the conveyance direction. A plurality of press rollers 35 are provided along the passage R4.

The passage R4 is located on an upper one of opposite sides of the recording position, namely, located on one of opposite sides of the recording position on which the ejection surface 10*a* is present, and is curved in a direction opposite to a direction in which the passage R1 is curved. That is, in FIG. 1, the passage R1 is curved so as to be convex leftward (namely, the bottom of the U-letter shape is located on a left side) while the passage R4 is curved so as to be convex rightward (namely, the bottom of the U-letter shape is located on a right side). Thus, the passages R1-R4 have an inverted S-letter shape as a whole. The opposite sides include one side of the recording position on which the ejection surface 10*a* is present and the other side of the recording position on which the ejection surface 10*a* is not present. The surface of the platen 61 may be positioned on the other side of the recording position.

The passage T1 extends downward in the vertical direction and is defined by a guide 95*a* and a roller pair 96.

The passage T2 extends along the sub scanning direction in a direction opposite to a direction of extension of the passage R2 and is defined by a guide 95*b* and a roller pair 97.

The passage T3 extends obliquely upwardly to the intermediate portion of the passage R1 and is defined by a guide 95*c*.

The press rollers 33-35 are disposed at respective positions at which the press rollers 33-35 are opposed to the surface of the sheet P (on which the image has been or to be recorded). The press rollers 33-35 have a function of pressing the sheet P so as to prevent the sheet P from floating above the conveyance passage.

Each of the guides 31*a*-31*d*, 32*a*, 32*b*, 33*a*, 33*b* is a member having a guide surface for guiding the sheet P.

Each of the roller pairs 22-29 is constituted by a drive roller connected to a conveyance motor and a driven roller configured to rotate in accordance with rotation of the drive roller. The drive roller of each of the roller pairs 22-24 is disposed on an inner side of the U-letter shaped passage R1 while the driven roller of each of the roller pairs 22-24 is disposed on an outer side of the U-letter shaped passage R1. In each of the roller pairs 25-27, the lower one of the two rollers in each roller pair is the drive roller while the upper one of the two rollers in each pair is the driven roller. The drive roller of each of the roller pairs 28, 29 is disposed on an outer side of the U-letter shaped passage R4 while the driven roller of each of the roller pairs 28, 29 is disposed on an inner side of the U-letter shaped passage R4. The upper one of the two rollers in each of roller pairs 26, 27 may be two first rollers. The lower one 26*b*, 27*b* of the two rollers in each of roller pairs 26, 27 may be two second rollers.

Each of the press rollers 33, 34 and upper rollers of the respective roller pairs 25-27 is a spur roller having a metal portion with a plurality of protrusions formed on its outer circumference. Each of the other rollers (i.e., the rollers of the roller pairs 22-24, 28, 29 and the press roller 35) is a rubber roller having a rubber layer formed on its outer circumference.

Figure 2:
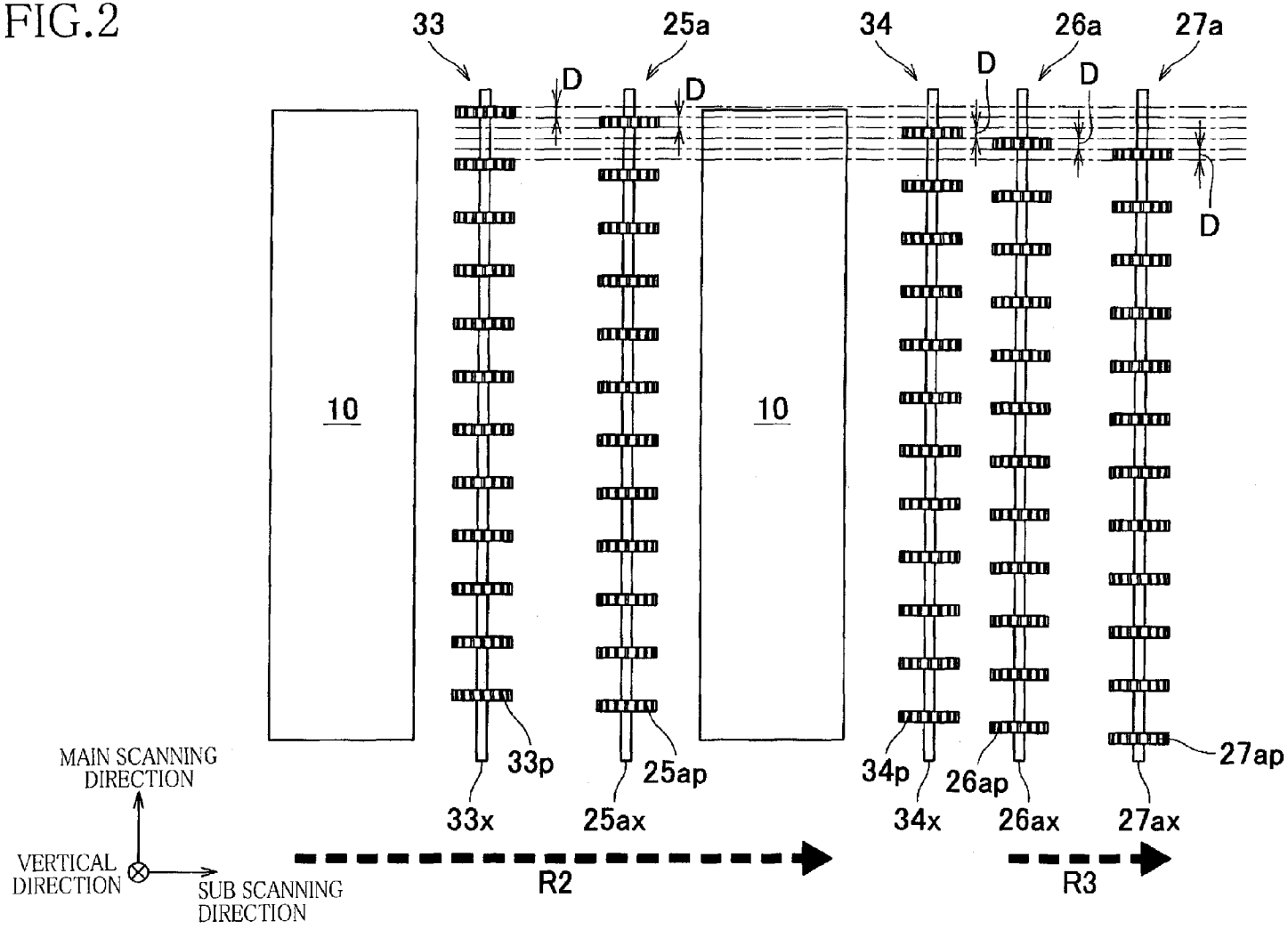
FIG. 2 is a fragmentary plan view showing two heads and a part of rollers of a conveyance unit included in the printer of FIG. 1.

Referring to FIG. 2, the structure of each of the press rollers 33, 34 and the upper rollers of the roller pairs 25-27 will be explained in detail.

As shown in FIG. 2, the press rollers 33, 34 and the upper rollers 25*a*, 26*a*, 27*a* of the respective roller pairs 25, 26, 27 respectively have: a shaft 33*x*, a shaft 34*x*, a shaft 25*ax*, a shaft 26*ax*, and a shaft 27*ax* each extending along the main scanning direction; and partial rollers 33*p*, partial rollers 34*p*, partial rollers 25*ap*, partial rollers 26*ap*, and partial rollers 27*ap*. The partial rollers 33*p*, 34*p*, 25*ap*, 26*ap*, 27*ap* of each roller are disposed so as to be spaced apart from each other by an equal distance in a direction of extension of the corresponding shafts 33*x*, 34*x*, 25*ax*, 26*ax*, 27*ax*. The partial rollers 33*p*, 34*p*, 25*ap*, 26*ap*, 27*ap* have the same construction. Each of the partial rollers 33*p*, 34*p*, 25*ap*, 26*ap*, 27*ap* is a disc-like member having a thickness D in the main scanning direction and has protrusions formed on its outer circumference.

The partial rollers 33*p*, 34*p*, 25*ap*, 26*ap*, 27*ap* are disposed in a zigzag fashion as a whole as shown in the plan view of FIG. 2 and do not overlap in the sub scanning direction, i.e., in the conveyance direction. In other words, the partial rollers 33*p*, 34*p*, 25*ap*, 26*ap*, 27*ap* are disposed so as not to overlap each other as viewed from the upstream side or the downstream side in the conveyance direction.

More specifically, except for the press roller 33 located most upstream among the spur rollers in the conveyance direction, the partial rollers of each of the rollers 34, 25*a*, 26*a*, 27*a* are disposed so as to be shifted by a distance D in the main scanning direction (i.e., in a downward direction in FIG. 2) with respect to the partial rollers of another roller that is located immediately upstream of the roller in question. For instance, the partial rollers 25*ap* of the upper roller 25*a* are disposed so as to be shifted by the distance D in the main scanning direction with respect to the partial rollers 33*p* of the press roller 33, and the partial rollers 34*p* of the press roller 34 are disposed so as to be shifted by the distance D in the main scanning direction with respect to the partial rollers 25*ap* of the upper roller 25*a*.

Figure 3:
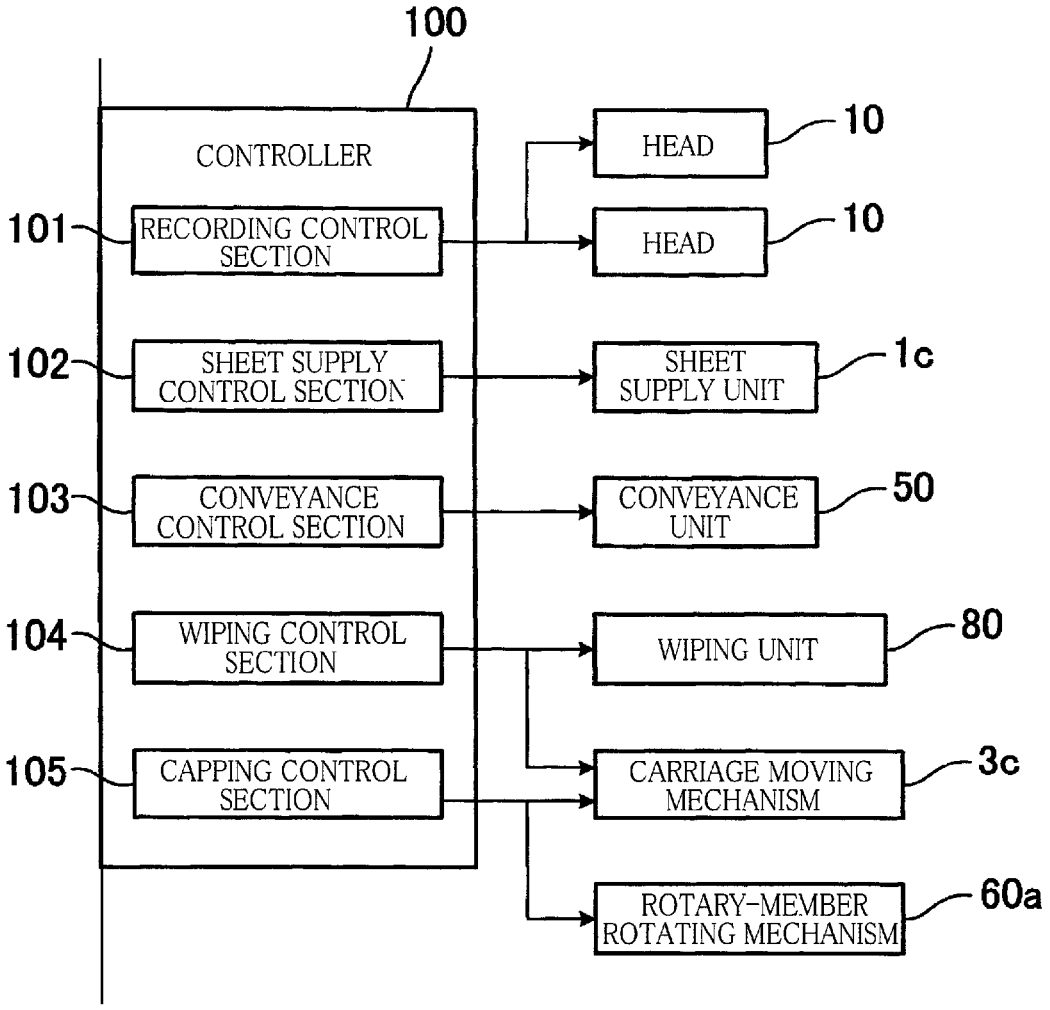
FIG. 3 is a block diagram showing an electric structure of the printer shown in FIG. 1.

As shown in FIG. 1, the slide shafts 81 of the wipers are provided below the press rollers 33, 34, respectively. Each wiper (not shown) is an elastic member included in the wiping unit 80 (FIG. 3). The wipers are provided for the respective heads 10. The wiping unit 80 includes the wipers, a slide mechanism for slidingly move the wipers along the slide shafts 81, a drive motor for the wipers, and so on. Each wiper is disposed at a position at which the wiper is not opposed to the ejection surface 10*a* of a corresponding one of the heads 10 in the vertical direction, namely, disposed on the back side of the corresponding head 10 in the main scanning direction (FIG. 1), except when wiping is carried out. The wiping unit 80 is configured to carry out wiping under a control of the controller 100 such that the wipers are moved in the main scanning direction with the wipers kept in contact with the corresponding ejection surfaces 10*a* of the heads 10, thereby removing foreign substances on the ejection surfaces 10*a*.

Referring next to FIG. 3, there will be explained a structure of the controller 100 and a control of various sections of the printer 1 by the controller 100.

The controller 100 includes a Central Processing Unit (CPU) as an arithmetic processing unit, a Read Only Memory (ROM), a Random Access Memory (RAM including a non-volatile RAM), an Application Specific Integrated Circuit (ASIC), an Interface (I/F), and an Input/Output Port (I/O). In the ROM, programs to be executed by the CPU, various fixed data, etc., are stored. In the RAM, data such as image data required in execution of the programs are temporarily stored. In the ASIC, rewriting and sorting of the image data such as signal processing and image processing are executed. The I/F performs transmission and reception of data with an external device such as a personal computer (PC) connected to the printer 1. The I/O performs input/output of detection signals of various sensors. The controller 100 is constituted so as to establish various functional sections such as a recording control section 101, a sheet supply control section 102, a conveyance control section 103, a wiping control section 104, a capping control section 105, by a cooperative function of software such as the programs stored in the ROM and hardware such as the CPU, etc.

The recording control section 101 is configured to control the two heads 10 such that the heads 10 eject the liquids to the sheet P on the basis of the image data.

The sheet supply control section 102 is configured to control a drive motor of the sheet supply roller 21 such that the uppermost one of the sheets P accommodated in the sheet tray 20 is fed by the sheet supply roller 21.

The conveyance control section 103 is configured to control the conveyance motor of the conveyance unit 50 such that the sheet P is conveyed along the conveyance passage. The conveyance control section 103 is configured to control the conveyance motor of the conveyance unit 50 such that the sheet P is conveyed without stopping the sheet P during a time period in which recording is being performed on the sheet P by the heads 10.

The recording control section 101, the sheet supply control section 102, and the conveyance control section 103 are configured to control various portions while synchronizing conveyance of the sheet P and ejection of the liquids from the heads 10 to each other.

More specifically, the sheet P supplied from the sheet tray 20 under a control of the sheet supply control section 102 is conveyed so as to initially pass through the passages R1, R2 in this order under a control of the conveyance control section 103, and subsequently passes right below the heads 10 (the recording positions) at the passage R2 while being supported or held on the support surfaces 61*a*. On this occasion, the heads 10 are driven under a control of the recording control section 101, and the liquids are ejected to the sheet P from the ejection openings of the ejection surfaces 10*a*, so that an image is formed on the sheet P. Thereafter, the sheet P is discharged to the discharge portion 1*e* in the single-sided recording. In the duplex recording, the sheet P is conveyed back without being discharged to the discharge portion 1*e*, and is conveyed along the passages T1-T3 so as to be sent to the intermediate portion of the passage R1. The sheet P sent to the intermediate portion of the passage R1 again passes through the passage R2-R4 and is finally discharged to the discharge portion 1*e* after an image has been formed on the back surface of the sheet P.

In the present embodiment, the conveyance control section 103 controls the conveyance motors connected to the respected drive rollers of the roller pairs 22-29 so as to rotate at the same speed. However, owing to a difference in the gear ratios of respective drive mechanisms for driving the respective roller pairs 22-29, a sheet conveyance speed V1 of the roller pair 27, a sheet conveyance speed V2 of the roller pair 26, and a sheet conveyance speed V3 of the roller pair 28 have a relationship represented as V1>V2>V3.

The wiping control section 104 initially controls the carriage moving mechanism 3*c* in accordance with a wiping command so as to move the carriage 3*b* upward for thereby retracting the ejection surfaces 10*a* upward, such that a distance between the ejection surfaces 10*a* and the support surfaces 61*a* becomes larger. The wiping control section 104 then controls the drive motor of the wiping unit 80 such that the wipers slide along the slide shafts 81. On this occasion, foreign substances on the ejection surfaces 10*a* are removed by the wipers, namely, wiping is performed. After completion of the wiping, the wiping control section 104 controls the carriage moving mechanism 3*c* to move the carriage 3*b* downward, thereby moving the heads 10 downward such that the ejection surfaces 10*a* are located at respective original positions.

The capping control section 105 initially controls the carriage moving mechanism 3*c* in accordance with a capping command so as to move the carriage 3*b* upward for thereby retracting the ejection surfaces 10*a* upward such that the ejection surfaces 10*a* do not interfere with the rotary members 63. The capping control section 105 then controls the rotary-member rotating mechanism 60*a* to rotate the rotary members 63, whereby the first state is switched to the second state. Thereafter, the capping control section 105 controls the carriage moving mechanism 3*c* to move the carriage 3*b* downward, for thereby moving the heads 10 down such that the ejection surfaces 10*a* are located at the respective original positions. On this occasion, the lower end of each cap member (not shown) comes into contact with the corresponding opposable face 62*a*, whereby a space that is opposed to the ejection surface 10*a* is closed or sealed from the external space, for establishing a capping state. By the capping, the ink in the ejection openings is prevented from drying.

As described above, in the printer 1 according to the present embodiment, when the leading end portion of the sheet P is located at the curved passage R4, the trailing end portion of the sheet P is located at the recording position at which the sheet P is opposed to the ejection surface 10*a* of the ink-jet head 10, and a portion of the sheet P intermediate between the leading end portion and the trailing end portion is located at the flat passage R3. In this instance, the portion of the sheet P located at the flat passage R3 is nipped by the roller pairs 26, 27 and is placed in a flat state along the flat passage R3. A force in a direction orthogonal to the ejection surface 10*a* which is to be generated in the trailing end portion of the sheet P due to the leading end portion of the sheet P that is being located at the curved passage R4 is reduced by the flat passage R3. Accordingly, the force in the direction orthogonal to the ejection surface 10*a* is not likely to act on the trailing end portion of the sheet P. Therefore, even where the curved passage R4 is provided on the downstream side of the recording position in the conveyance direction, it is possible to suppress floating of the trailing end portion of the sheet P.

The following problem may arise in an instance in which the curved passage R4 is provided on the downstream side of the recording position in the conveyance direction and the at least two roller pairs that define the flat passage R3 are not disposed between the recording position and the curved passage R4. That is, when the leading end portion of the sheet P is located at the curved passage R4, the leading end portion is curved along the curved passage R4. In this instance, since the sheet P undergoes a force which permits the sheet P to return to the original flat state, the trailing end portion of the sheet P undergoes a force in a direction away from the curved passage R4 with respect to the direction orthogonal to the ejection surface 10*a*, namely, a force in a downward direction in FIG. 1.

For instance, where the curved passage R4 is located on the upper one of the opposite sides of the recording position, namely, on one of opposite sides of the recording position on which the ejection surface 10*a* is present as in the present embodiment, the trailing end portion of the sheet P undergoes a force in a direction from the ejection surface 10*a* toward the support surface 61*a* (a force in the downward direction in FIG. 1). By this force, the trailing end portion of the sheet P is pressed onto the support surface 61*a*. However, on this occasion, a reaction force against the force that presses the trailing end portion of the sheet P onto the support surface 61*a* acts on the trailing end portion of the sheet P, so that there may be a possibility that the trailing end portion of the sheet P floats away from the support surface 61*a*.

On the other hand, where the curved passage R4 is located on the lower one of the opposite sides of the recording position, namely, on the other of the opposite sides of the recording position on which the ejection surface 10*a* is not present, the trailing end portion of the sheet P undergoes a force in a direction from the support surface 61*a* toward the ejection surface 10*a* (a force in the upward direction in FIG. 1). In this instance, there may be a possibility that the trailing end portion of the sheet P floats away from the support surface 61*a*.

If the trailing end portion of the sheet P floats away from the support surface 61*a* as described above, the distance between the sheet P and the ejection surface 10*a* may change, thereby causing a problem of deteriorated image quality or a problem of contact of the sheet P with the ejection surface 10*a*. Moreover, the ejection surface 10*a* may be damaged.

In the roller pairs 26, 27 which define the flat passage R3, the upper rollers 26*a*, 27*a* disposed on the one of the opposite sides of the recording position on which the ejection surface 10*a* is present (i.e., on the upper one of the opposite sides of the recording position in FIG. 1) may come into contact with the recorded surface of the sheet P immediately after the recording, and therefore the recorded image may be disordered or deteriorated due to the contact of the upper rollers 26*a*, 27*a* with the recorded surface of the sheet P.

In view of this, in the present embodiment, the upper rollers 26*a*, 27*a* are constituted by the plurality of partial rollers 26*ap*, 27*ap*, and the partial rollers 26*ap* and the partial rollers 27*ap* are disposed so as not to overlap each other in the conveyance direction, namely, so as not to overlap each other as viewed from the upstream side or the downstream side in the conveyance direction, as shown in FIG. 2. According to the arrangement, the recorded surface of the sheet P contacts the partial rollers 26*ap*, 27*ap* at different local portions, namely, portions of the recorded surface of the sheet P that come into contact with the partial rollers 26*ap*, 27*ap* are dispersed over the entirety of the recorded surface. In other words, it is possible to prevent the same local portion of the recorded surface of the sheet P from repeatedly come into contact with the partial rollers 26*ap*, 27*ap*, thereby restraining the recorded image from being disordered or deteriorated.

Further, local portions of the recorded surface of the sheet P that come into contact with the partial rollers 26*ap*, 27*ap* are increased in the arrangement described above, as compared with an arrangement in which partial rollers 26*ap*, 27*ap* are disposed so as to overlap each other in the conveyance direction, namely, so as to overlap each other as viewed from the upstream side or the downstream side in the conveyance direction. Therefore, it is possible to prevent, with higher reliability, the trailing end portion of the sheet P from floating.

Each of the partial rollers 26*ap*, 27*ap* in the roller pairs 26, 27 is the spur roller with the plurality of protrusions formed on the outer circumference thereof.

In the spur roller, the area of contact thereof with the recorded surface is small, and the spur roller comes into point contact with the recorded surface. Accordingly, in the arrangement described above, it is possible to prevent, with higher reliability, the recorded image from being disordered or deteriorated.

The conveyance unit 50 includes the press roller 34. Accordingly, it is possible to prevent, with higher reliability, the trailing end portion of the sheet P from floating owing to the roller pairs 26, 27 and the press roller 34.

More specifically, it is preferable to dispose the roller pairs that define the flat passage R3 at a position which is located immediately downstream of the recording position in the conveyance direction. However, where a component such as the slide shaft 81 is disposed at the above-indicated immediately downstream position on the other of the opposite sides of the recording position on which the ejection surface 10*a* is not present (i.e., on the lower one of the opposite sides of the recording position in FIG. 1), the roller pairs cannot be disposed at the position in question. Even in such an instance, by disposing the press roller 34 at the above-indicated immediately downstream position on the one of the opposite sides of the recording position on which the ejection surface 10*a* is present (i.e., on the upper one of the opposite sides of the recording position in FIG. 1) as in the present embodiment, it is possible to prevent the trailing end portion of the sheet P from floating in the vicinity of the recording position. Further, the floating of the trailing end portion of the sheet P can be prevented with higher reliability owing to a cooperative action of the roller pairs 26, 27 and the press roller 34.

The press roller 34 may come into contact with the recorded surface of the sheet P immediately after the recording, and therefore the recorded image may be disordered or deteriorated due to the contact of the press roller 34 with the recorded surface of the sheet P.

In view of this, in the present embodiment, the press roller 34 is constituted by the plurality of partial rollers 34*p*, and the partial rollers 34*p*, the partial rollers 26*ap*, 27*ap* of the upper rollers 26*a*, 27*a* are disposed so as not to overlap each other in the conveyance direction, namely, so as not to overlap each other as viewed from the upstream side or the downstream side in the conveyance direction as shown in FIG. 2. According to the arrangement, the recorded surface of the sheet P contacts the partial rollers 34*p*, 26*ap*, 27*ap* at different local portions, namely, portions of the recorded surface of the sheet P that come into contact with the partial rollers 34*p*, 26*ap*, 27*ap* are dispersed over the entirety of the sheet P. In other words, it is possible to prevent the same local portion of the recorded surface of the sheet P from repeatedly come into contact with the partial rollers 34*p*, 26*ap*, 27*ap*, thereby restraining the recorded image from being disordered or deteriorated.

Further, local portions of the recorded surface of the sheet P that come into contact with the partial rollers 34*p*, 26*ap*, 27*ap* are increased in the arrangement described above, as compared with an arrangement in which partial rollers 34*p*, 26*ap*, 27*ap* are disposed so as to overlap each other in the conveyance direction, namely, so as to overlap each other as viewed from the upstream side or the downstream side in the conveyance direction. Therefore, it is possible to prevent, with higher reliability, the trailing end portion of the sheet P from floating.

Each of the partial rollers 34*p* of the press roller 34 is the spur roller with the plurality of protrusions formed on the outer circumference thereof.

In the spur roller, the area of contact thereof with the recorded surface is small, and the spur roller comes into point contact with the recorded surface. Accordingly, in the arrangement described above, it is possible to prevent, with higher reliability, the recorded image from being disordered or deteriorated.

The conveyance unit 50 is configured to convey, under a control of the controller 100, the sheet P without stopping the sheet P during a time period in which the recording is being performed on the sheet P by the head 10.

Where the sheet P is conveyed without being stopped, image quality deterioration due to floating of the trailing end portion of the sheet P or the like may be problematic although high-speed recording can be realized. In the present embodiment, however, floating of the trailing end portion of the sheet P can be suppressed, thereby enabling high-speed recording while suppressing the problem of image quality deterioration or the like.

In the illustrated embodiment, the curved passage R4 has the U-letter shape, and the conveyance unit 50 is configured to convey the sheet P such that the recorded surface of the sheet P which has faced the ejection surface 10*a* at the recording position faces the support member 1*e*1 at the discharge portion 1*e*, namely, faces downward in FIG. 1.

If the conveyance unit is configured to convey the sheet P such that the recorded surface of the sheet P does not face the support member 1*e*1 at the discharge portion 1*e*, namely, faces upward in FIG. 1, the user needs to turn each of the recorded sheets P upside down and to rearrange the recorded sheets P in order in an instance where the recording is successively performed on a plurality of sheets P and the plurality of recorded sheets P are successively discharged. In contrast, the present embodiment eliminates such a need.

In the illustrated embodiment, the sheet conveyance speed V1 of the roller pair 27 and the sheet conveyance speed V2 of the roller pair 26 have the relationship represented as V1>V2.

In this instance, tension acts on a portion of the sheet P between the roller pair 26 and the roller pair 27, whereby the portion of the sheet P is prevented from being flexed so as to have an enhanced degree of flatness. Further, the force in the direction orthogonal to the ejection surface 10*a* which is likely to be generated in the trailing end portion of the sheet P due to the leading end portion of the sheet P that is being located at the curved passage R4 can be reduced by the flat passage R3 at which the trailing end portion of the sheet P is located. Therefore, the force in the direction orthogonal to the ejection surface 10*a* is not likely to act on the trailing end portion of the sheet P, thereby suppressing, with a higher reliability, floating of the trailing end portion of the sheet P.

In the illustrated embodiment, the sheet conveyance speed V1 of the roller pair 27 and the sheet conveyance speed V3 of the roller pair 28 have the relationship represented as V1>V3.

In this instance, there can be positively generated flexure in a portion of the sheet P between the roller pair 27 and the roller pair 28. Accordingly, it is possible to suppress a variation of the conveyance speed at a time when the leading end portion of the sheet P reaches the roller pair 28. That is, the sheet P can be smoothly conveyed from the flat passage R3 to the curved passage R4.

While the embodiment of the present invention has been explained, it is to be understood that the present invention is not limited to the details of the illustrated embodiment but may be otherwise embodied with various changes and modifications, without departing from the scope of the invention defined in the attached claims, as described below.

The passages for re-conveyance may be eliminated. The roller pair 25 disposed between the two heads 10 may be eliminated. The press rollers may be eliminated. The layout of the partial rollers constituting the spur rollers may be suitably changed. For instance, the partial rollers of the press roller 34, the partial rollers of the upper roller 26*a*, and the partial rollers of the upper roller 27*a* shown in FIG. 2 may overlap each other in the conveyance direction, namely, may overlap each other as viewed from the upstream side or the downstream side in the conveyance direction. The spur roller is not limited to the one in the illustrated embodiment having the plurality of partial rollers, but may have a structure in which a plurality of protrusions are formed on a circumference of a cylindrical roller. The thus structured spur roller also comes into point contact with the recorded surface, thereby preventing the recorded image from being disordered or deteriorated. Each of the rollers such as the intermediate roller and the upper rollers of the roller pairs which may contact the recorded surface of the recording medium immediately after recording may not be the spur roller.

At the discharge position, the recording medium may be placed on the support member such that the recorded surface of the recording medium does not face the support member. The shape of the curved passage is not limited to the U-letter shape, but may be an S-letter shaper or the like. The curved passage is not limited to be provided on the one of the opposite sides of the recording position on which the ejection surface is present, but may be provided on the other of the opposite sides of the recording position on which the ejection surface is not present, as long as the curved passage is provided on the downstream side of the recording position in the conveyance direction. For instance, the present invention is applicable to an arrangement in which, in a liquid ejecting apparatus capable of performing duplex recording, a reverse unit for reversing the recording medium is provided on the other of the opposite sides of the recording position on which the ejection surface is not present (i.e., on the lower one of the opposite sides of the recording position in FIG. 1) and the curved passage is provided between the recording position and the reverse unit (i.e., on the other of the opposite sides of the recording position on which the ejection surface is not present).

In the illustrated embodiment, the relationship V1>V2>V3 is established by the difference in the gear ratios. The relationship may be otherwise established. For instance, the relationship V1>V2>V3 may be established by a difference in the roller diameters, a difference in the rotation speeds of the conveyance motors corresponding to the respective rollers. The conveyance motors are connected to the respective drive rollers in each of the roller pairs 22-29. A common conveyance motor may be connected to the drive rollers of each of the roller pairs 22-29. In this instance, the relationship V1>V2>V3 may be established by the difference in the gear ratios. Only the relationship V1>V2 or only the relationship V1>V3 may be established. The V1-V3 may not have the relationship described above. For instance, the sheet conveyance speeds V1-V3 may be mutually the same.

The conveyance mechanism may be configured to intermittently convey the recording medium during a time period in which the recording is performed on the recording medium. The number of the roller pairs which define the flat passage is at least two and may be three or more.

The direction of extension of the ejection surface is not limited to the horizontal direction, but may be the vertical direction, etc.

The head may be configured to eject any arbitrary liquid other than the pre-treatment liquid and the ink. The liquid ejecting apparatus may have at least one head.

The recording medium is not limited to the sheet P, but may be any arbitrary recordable media. The liquid ejecting apparatus according to the present invention has the conveyance mechanism configured such that the trailing end portion of the recording medium of a prescribed size is located at the recording position when the leading end portion of the recording medium is located at the curved passage. The conveyance mechanism may be configured to convey recording media of a plurality of sizes other than the prescribed size. That is, the conveyance mechanism may be configured such that, among the recording media of the plurality of sizes, the trailing end portion of at least one recording medium of at least one size is located the recording position when the leading end portion of the at least one recording medium is located at the curved passage.

The present invention is applicable to not only the printer, but also a facsimile machine, a copying machine and the like.

What is claimed is:

1. A liquid ejecting apparatus, including:

at least one line-type head each having an ejection surface in which are open a plurality of ejection openings through which a liquid is ejected to a recording medium; and a conveyance mechanism configured to convey the recording medium in a conveyance direction such that the recording medium passes at least one recording position at which the recording medium is opposed to the ejection surface, the conveyance mechanism including a curved-passage defining portion which defines a curved passage located on a downstream side of the lowermost downstream recording position of the at least one recording position in the conveyance direction and a flat-passage defining portion which defines a flat passage which is located between the lowermost downstream recording position of the at least one recording position in the conveyance direction and the curved passage and which is parallel to the ejection surface, a trailing end portion of a certain recording medium being located at the recording position when a leading end portion of the certain recording medium is being located at the curved passage, wherein the flat-passage defining portion includes at least two roller pairs which are disposed so as to define the flat passage and disposed such that the at least two roller pairs are located apart from each other in the conveyance direction and each is configured to nip the recording medium at the flat passage therebetween.

2. The liquid ejecting apparatus according to claim 1, wherein the at least two roller pairs include at least two first rollers positioned on one side of the recording medium on which the ejection surface is present, wherein each of the at least two first rollers includes a plurality of partial rollers which are spaced apart from each other in an axial direction of the one of the first rollers, and wherein the plurality of partial rollers of the one of the two first rollers and the plurality of partial rollers of another of the two first rollers are arranged so as not to overlap each other as viewed from an upstream side or a downstream side in the conveyance direction.

3. The liquid ejecting apparatus according to claim 2, wherein each of the plurality of partial rollers is a spur roller having a plurality of protrusions on an outer circumference thereof.

4. The liquid ejecting apparatus according to claim 2, wherein the conveyance mechanism further includes an intermediate roller which is disposed on an upstream side of the at least two roller pairs in the conveyance direction and which is disposed on the one side of the recording medium on which the ejection surface is present.

5. The liquid ejecting apparatus according to claim 4, wherein the intermediate roller includes a plurality of partial rollers which are spaced apart from each other in an axial direction of the intermediate roller, and wherein the plurality of partial rollers of the intermediate roller and the plurality of partial rollers of each of the first two rollers are disposed so as not to overlap each other as viewed from the upstream side or the downstream side in the conveyance direction.

6. The liquid ejecting apparatus according to claim 5, wherein each of the plurality of partial rollers of the intermediate roller is a spur roller having a plurality of protrusions on an outer circumference thereof.

7. The liquid ejecting apparatus according to claim 1, further comprising a controller, wherein the controller is configured to control the conveyance mechanism to convey the recording medium without stopping the recording medium in a time period during which recording is being performed on the recording mediums by the head.

8. The liquid ejecting apparatus according to claim 1, wherein the at least two roller pairs include at least two first rollers positioned on one side of the recording medium on which the ejection surface is present, and wherein the curved passage is located on the one side of the recording medium on which the ejection surface is present.

9. The liquid ejecting apparatus according to claim 8, wherein the curved passage has a U-like shape, wherein the liquid ejecting apparatus further includes a support member disposed at a discharge position located on a downstream side of the curved passage in the conveyance direction for supporting a discharged recording medium, and wherein the conveyance mechanism is configured to convey the recording medium such that a recorded surface of the recording medium which has been opposed to the ejection surface at the recording position faces the support member at the discharge position.

10. The liquid ejecting apparatus according to claim 1, further comprising a controller, wherein the at least two roller pairs includes a first roller pair located most downstream in the conveyance direction and a second roller pair located on an upstream side of the first roller pair, and wherein the controller is configured to control the conveyance mechanism such that a conveyance speed V1 of the recording medium by the first roller pair is higher than a conveyance speed V2 of the recording medium by the second roller pair.

11. The liquid ejecting apparatus according to claim 1, further comprising a controller, wherein the at least two roller pairs includes a first roller pair located most downstream in the conveyance direction and the curved-passage defining portion includes a third roller pair located in the curved passage defining portion, and wherein the controller is configured to control the conveyance mechanism such that a conveyance speed V1 of the recording medium by the first roller pair is higher than a conveyance speed V3 of the recording medium by the third roller pair.

12. A liquid ejecting apparatus, including a line-type head having an ejection surface in which are open a plurality of ejection openings through which a liquid is ejected to a recording medium; and a conveyance mechanism configured to convey the recording medium in a conveyance direction such that the recording medium passes a recording position at which the recording medium is opposed to the ejection surface, the conveyance mechanism including a curved-passage defining portion which defines a curved passage located on a downstream side of the recording position in the conveyance direction and a flat-passage defining portion which defines a flat passage which is located between the recording position and the curved passage and which is parallel to the ejection surface, a trailing end portion of the recording medium being located at the recording position when a leading end portion of the recording medium is located at the curved passage, wherein the flat-passage defining portion includes at least two roller pairs which are disposed so as to define the flat passage, wherein the at least two roller pairs include at least two first rollers positioned on one side of the recording position on which the ejection surface is present and at least two second rollers positioned on the other side of the recording position on which the ejection surface is not present, wherein each of the at least two first rollers includes a plurality of partial rollers which are spaced apart from each other in an axial direction of the one of the first rollers, and wherein the plurality of partial rollers of the one of the two rollers in one of the at least two roller pairs and the plurality of partial rollers of the one of the two rollers in another of the at least two roller pairs are arranged so as not to overlap each other as viewed from an upstream side or a downstream side in the conveyance direction.

13. A liquid ejecting apparatus, including:

a line-type head having an ejection surface in which are open a plurality of ejection openings through which a liquid is ejected to a recording medium; and a conveyance mechanism configured to convey the recording medium in a conveyance direction such that the recording medium passes a recording position at which the recording medium is opposed to the ejection surface, the conveyance mechanism including a curved-passage defining portion which defines a curved passage located on a downstream side of the recording position in the conveyance direction and a flat-passage defining portion which defines a flat passage which is located between the recording position and the curved passage and which is parallel to the ejection surface, a trailing end portion of the recording medium being located at the recording position when a leading end portion of the recording medium is located at the curved passage, wherein the flat-passage defining portion includes at least two roller pairs which are disposed so as to define the flat passage, wherein the at least two roller pairs include at least two first rollers positioned on one side of the recording position on which the ejection surface is present and at least two second rollers positioned on the other side of the recording positioned on which the ejection surface is not present, and wherein the curved passage is located on the one side of the recording position on which the ejection surface is present.

* * * * *